United States Patent [19]

Anderka

[11] Patent Number: 4,930,921

[45] Date of Patent: Jun. 5, 1990

[54] TUBULAR WRITTING PEN WITH SUPERPOSED PRESSURE EQUALIZATION CHAMBERS

[75] Inventor: Gerold Anderka, Ellerbek, Fed. Rep. of Germany

[73] Assignee: Koh-I-Noor Rapidograph, Inc., Bloomsbury, N.J.

[21] Appl. No.: 287,602

[22] Filed: Dec. 22, 1988

Related U.S. Application Data

[63] Continuation of Ser. No. 834,514, Feb. 28, 1986, abandoned, which is a continuation of Ser. No. 529,654, Sep. 16, 1983, abandoned, which is a continuation of Ser. No. 236,411, Feb. 20, 1981, abandoned.

[30] Foreign Application Priority Data

Mar. 10, 1980 [DE] Fed. Rep. of Germany ..... 3009100
Mar. 10, 1980 [DE] Fed. Rep. of Germany ..... 3009169
Mar. 10, 1980 [DE] Fed. Rep. of Germany ... 8006529[U]

[51] Int. Cl.[5] ..... B43K 8/00; B43K 5/18

[52] U.S. Cl. ..... 401/258; 401/135; 401/251; 401/225; 401/259

[58] Field of Search ..... 401/258, 259, 260, 242, 401/225–229, 250, 251, 135; 403/320

[56] References Cited

U.S. PATENT DOCUMENTS

| | | | |
|---|---|---|---|
| 915,735 | 3/1909 | Brown | 403/320 X |
| 2,401,167 | 11/1941 | Kovacs . | |
| 2,951,466 | 9/1960 | Bross | 120/45.4 |
| 3,418,058 | 7/1966 | Gossel . | |
| 3,427,116 | 5/1966 | Riepe . | |
| 3,442,597 | 5/1969 | Hebrorn et al. | 401/259 |
| 3,539,269 | 5/1969 | Dahle . | |
| 3,788,754 | 1/1974 | Glasa | 401/259 X |
| 3,824,023 | 7/1974 | Danjczek et al. | 401/258 |
| 3,870,421 | 12/1972 | Mutschler . | |
| 4,102,584 | 7/1978 | Anderka | 401/259 |

FOREIGN PATENT DOCUMENTS

| | | | |
|---|---|---|---|
| 738888 | 9/1943 | Fed. Rep. of Germany . | |
| 1947421 | 8/1965 | Fed. Rep. of Germany . | |
| 1254506 | 11/1967 | Fed. Rep. of Germany . | |
| 1278284 | 9/1968 | Fed. Rep. of Germany . | |
| 1911951 | 9/1970 | Fed. Rep. of Germany . | |
| 2216706 | 10/1973 | Fed. Rep. of Germany | 401/258 |
| 2460345 | 10/1975 | Fed. Rep. of Germany | 401/258 |
| 1967021 | 6/1976 | Fed. Rep. of Germany | 401/258 |
| 2844886 | 8/1979 | Fed. Rep. of Germany | 401/259 |
| 743853 | 4/1933 | France . | |
| 1118717 | 6/1956 | France . | |
| 67451 | 3/1958 | France . | |
| 722046 | 1/1955 | United Kingdom . | |

*Primary Examiner*—Steven A. Bratlie
*Attorney, Agent, or Firm*—Fitzpatrick, Cella, Harper & Scinto

[57] ABSTRACT

Tubular writing pens of the stylographic type, as used by artists and technical draftsmen. Particularly a tubular writing pen having superposed inner and outer ink pressure equalization chambers defined in the cylindrical pen body. A removable outer sleeve complementally engages the cylindrical body of the pen, to cover the outer pressure equalization chamber. A locking surface is defined in the removable sleeve rear edge, so that the sleeve may not be removed accidently with consequent ink loss and damage.

9 Claims, 1 Drawing Sheet

TUBULAR WRITTING PEN WITH SUPERPOSED PRESSURE EQUALIZATION CHAMBERS

This application is a continuation of application Ser. No. 06/834,514 filed Feb. 28, 1986, which in turn is a continuation of Ser. No. 06/529,654, filed Sept. 6, 1983, which in turn is a continuation of Ser. No. 06/236,411, filed Feb. 20, 1981 all abandoned.

CROSS-REFERENCES TO RELATED APPLICATIONS

The present application corresponds to West German application, Ser. No's P 30 09 100.0, P 30 09 169.1 and G 80 06 529.8, all filed Mar. 10, 1980, priority being claimed.

BACKGROUND OF THE INVENTION

1. Field of the Invention:

This invention relates to an ink reservoir or cartridge for attachment to the posterior end of a tubular writing pen by being pushed over the rear end of a cylindrical body. The cylindrical body is hollow for supporting a writing tube at its front end. An ink pressure equalization chamber means is defined within a front wall region of the reservoir cartridge which cooperates with the exterior surface of the hollow body, adjacent the writing tube. The equalization chamber may be covered and sealed by the interior surface of a removable sleeve.

2. Description of the Prior Art:

A known ink reservoir cartridge of this type is illustrated in West German AS No. 19 67 021. Therein, an ink pressure equalization chamber is provided on the exterior surface of the forward end of the pen. The ink pressure equalization chamber is covered by a removable sleeve which threadly engages the cylindrical body, when the ink reservoir cartridge is attached. This removable sleeve is formed as a unitary piece for threaded engagement with the cylindrical body. A connecting bore extends transversely through the removable sleeve and opens directly into the interior chamber of the cylindrical body. The result is an ink pressure equalization chamber, which communicates at its posterior end with the interior chamber of the cylindrical body and its anterior end with ambient air. Accordingly, there is achieved in West German AS No. 19 67 021 a relatively great pressure differential between the anterior end of the writing tube and the transverse connecting bore. This relatively great pressure differential, thusly provided by the equalization chamber, is not optional. Also, the equalization chamber is relatively short and has, therefore, only a relatively limited volume in which to accomodate ink or writing fluid.

SUMMARY OF THE INVENTION

According to the present invention, there is disclosed a reservoir cartridge front wall region structure for defining superposed pressure equalization chambers in the front of the cylindrical body and the covering of these chambers with a removable sleeve whereby each time the sleeve is unmounted and the reservoir cartridge removed rearwardly off the cylindrical body, there will be exposure of the helical passages of both superposed equalization chambers.

The present invention concerns, also, an interlocking anchoring of the removable sleeve rear edge with respect to an annular collar which protrudes from the ink reservoir body. This interlocking prevents accidental removal of the removable sleeve from its covering of the exterior pressure equalization chamber and, thereby, avoids ink loss and damage.

Figure 1:
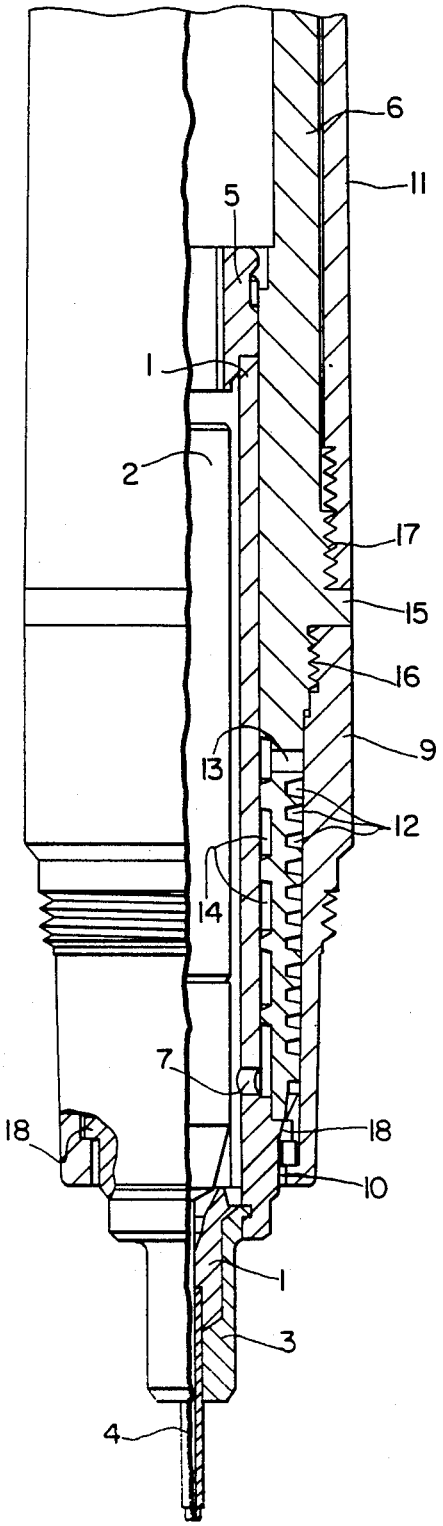
FIG. 1 is a fragmentary elevation, partially in section, of a tubular writing pen with the holder shaft threadedly attached.

DESCRIPTION OF THE PREFERRED EMBODIMENTS:

As illustrated in FIG. 1, the writing pen comprises cylindrical body 1 in which the anterior or front end supports writing tube 4 by means of metal attachment 3 set into cylindrical body 1. Within the interior bore of the tube-shaped cylindrical body 1, there is a fall weighted body 2, having at its forward end a conventional cleaning wire attached in a manner not described in any detail. The cleaning wire extends axially into writing tube 4 and may be reciprocated axially by the fall weighted body 2. A fall weight guide 5, provided with a central opening, is inserted into the posterior end of cylindrical body 1. Proximate the front end region of cylindrical body 1 there is defined transverse bore 7 which interconnects the exterior cylindrical surface of cylindrical body 1 and its interior bore.

An ink reservoir or cartridge 6 is attached by having its front end region pushed from the rear onto the posterior end of cylindrical body 1. The reservoir 6 forward edge makes contact with an annular collar 18 defined within cylindrical body 1. At the front wall region of ink reservoir 6, there is defined within its interior surface inwardly open passage as a helical inner equalization chamber 14, whose anterior or front end is connected with first or frontal transverse bore 7, while its posterior or rear end communicates with a second or rear connection bore 13, extending through the wall of the ink reservoir 6. This inner ink equalization chamber 14 open inner surface abuts the exterior smooth cylindrical surface of the cylindrical body 1 to create essentially a sealing attachment with the interior surface of the ink reservoir 6.

As will be apparent, inner pressure equalization chamber 14 may have a diminishing cross-section, according to the distance from connecting bore 13, so as to enhance ink flow. An exterior or outer helical ink equalization chamber 12 extends forwardly from posterior connecting bore 13 within the exterior surface of ink reservoir 6. As will be apparent, outer chamber 12 may have a decreasing cross-sectional area, according to the distance from bore 13, so as to impede ink flow. Rearwardly of this outer ink equalization chamber 12 there is an intermediate wall region of the reservoir cartridge which carries a first exterior thread 16 which extends rearwardly to an adjacent outwardly extending annular collar 15. A removable cylindrical sleeve 9 is screwed onto thread 16 from the front of the pen, so as to cover the outer equalization chamber 12, while forming axial openings 10 at the anterior end between sleeve 9 and cylindrical body 1. Axial openings 10 connect the anterior end of the outer ink equalization chamber 12 with ambient air. Otherwise, the anterior edge of sleeve 9 which extends radially inwardly secures cylindrical body 6 by abutment of the cylindrical forward edge of ink reservoir 6 with annular shoulder 18.

Thus, removable sleeve 9, shown affixed to the writing nib in FIG. 1, may be unscrewed from thread 16 and removed towards the front of the writing tube nib. As a result, ink reservoir cartridge front wall region may be removed by sliding the entire cartridge toward the rear of the smooth outer surfaced cylindrical body 1. The both ink equalization chamber passages and the ink reservoir 6 removed in this manner may then be cleaned and refilled. The inner and outer equalization chambers 12 and 14, as well as the connecting bore 13, may be easily cleaned at the same time without necessitating a special cleaning of the cylindrical body 1 or sleeve 9. Subsequently, the refilled ink reservoir 6 may be reattached by again pushing the cartridge front end region onto the outer surface of cylindrical body 1 and both elements operatively connected with one another by screwing on sleeve 9 to engage the internal and external threads 16.

Rearwardly of annular collar 15 there is a second exterior thread 17, defined in the exterior wall of the ink reservoir 6, onto which holder shaft 11 may be screwed.

Figure 2:
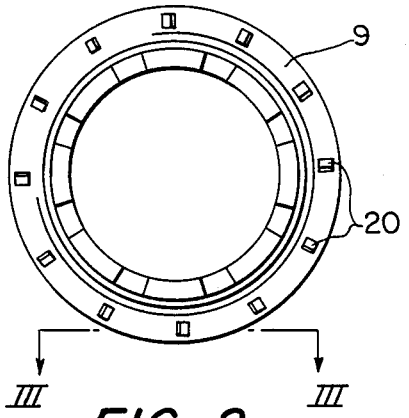
FIG. 2 is an end elevation of the removable sleeve rear edge, showing the sawtooth locking protrusion or teeth.
Figure 3:
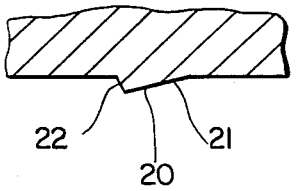
FIG. 3 is a fragmentary vertical section showing the intersecting extension of the individual sawtooth surfaces.

As can be seen in FIGS. 2 and 3, axially extending saw-toothed protrusions 20 are formed in the rear edge of removable sleeve 9. Inclined surfaces 21 and 22 extend axially beyond sleeve 9 rear edge, so as to intersect in the sawtooth configuration, illustrated in FIG. 3. The longer tooth surface 21 rise in the same direction as the direction of sleeve attaching thread 16. In the case of a customary right-handed thread 16, advancement of teeth surfaces 21 and 22 towards collar 15 occurs, as sleeve 9 is rotated in a counterclockwise direction when viewed from the rear.

When sleeve 9, consisting of a relatively hard plastic, is screwed on, the protrusions 21 "dig" into the anterior surface of annular collar 15, since ink reservoir 6 consists of somewhat softer plastic. A certain anchoring of sleeve part 9 against collar 15 is, thereby, provided. This anchoring prevents the user from holding the writing device with one hand on removable sleeve part 9, while the other hand on the holder shaft 11 screws off the first set of threads 16 from one another, instead of the second set of threads 17 and accidentally releases sleeve 9. As will be apparent, the resistance opposing this disengagement of sleeve 9 is greater as a result of the "anchoring" by means of the protrusions 20, than the resistance against disengagement of holder shaft 11. Only when the holder shaft 11 is unscrewed and the user holds the writing tip securely by the ink reservoir 6, can the sleeve 9 be disengaged.

It should be mentioned that a protective cap (not illustrated) may be attached to sleeve 9 from the front in order to protect writing tube 4 and the equalization chamber 12 connected with ambient air axial conduit 10. To this end a male thread, which is not shown in any detail, may be provided on a midportion of sleeve 9 exterior.

I claim:

1. In a tubular writing pen of the type having a soft plastic writing fluid reservoir cartridge (6) with a front end which is adapted to be pushed from the rear and forwardly onto the outer surface of a hard plastic cylindrical body (1) which has an inner bore to communicate ink from said reservoir cartridge to a writing capillary tube carried at the front end of said cylindrical body (1), the improvement which comprises a front wall region on said reservoir cartridge (6) that is configured to cooperate with said cylindrical body (1) and a surrounding cylindrical sleeve (9) so as to define an equalizing chamber means comprised of axially extending, interconnected helical passages, that is replaced with replacement of said reservoir cartridge, said equalizing chamber means further comprising an outer equalization chamber (12) and an inner equalization chamber (14), wherein the outer equalization chamber (12) further comprises outwardly open channels defined within an outer surface of said cartridge front wall region that are adapted to be covered by a smooth inner surface portion of a surrounding cylindrical sleeve (9), to define a first axially extending helical passage, said outer equalization chamber further having a rear end that terminates proximate to a connecting bore (13) that extends transversely through said front wall region in order to interconnect with said inner equalization chamber and a front end that communicates with surrounding air through an aperture defined between a front end of the cylindrical sleeve (9) and a portion of the outer surface of said cylindrical body (1), wherein further said inner equalizing chamber 14 comprises inwardly open channels defined within an inner surface of said reservoir cartridge front wall region, that are adapted to be covered by a smooth outer surface portion of said cylindrical body (1) to define a second axially extending helical passage, said inner equalization chamber further having a rear end which communicates with said connecting bore (13) and a front end that communicates with said cylindrical body inner bore through a transverse bore (7), means to mount said cylindrical sleeve (9) from the front and rearwardly into a surrounding relationship to the soft plastic reservoir cartridge front wall region, so as to cause a first sealing engagement between an inner surface of said sleeve and an outer surface of said reservoir cartridge and a second sealing engagement between a soft plastic inner equalization chamber front end and a hard plastic cylindrical body annular shoulder (18) proximate the front end of the cylindrical body (1), said cylindrical sleeve mounting means further comprising a reservoir cartridge intermediate wall region, posterior to the outer equalization chamber (12), which comprises an outer surface defined with a first external thread (16), and said cylindrical sleeve (9) has a first internal thread proximate its the rear end of said cylindrical sleeve (9) that is adapted to engage with said first external thread (16), whereby said cylindrical sleeve is adapted to surround and cover said reservoir cartridge front wall region, and axially urge the hard plastic cylindrical body annular shoulder (18) against the soft plastic inner equalization chamber front end upon an axial engagement of said cylindrical sleeve first internal thread rearwardly onto the first external thread (16) of the reservoir cartridge.

2. A tubular writing pen according to claim 1, wherein said soft plastic writing fluid reservoir cartridge (6) is constructed of a synthetic material which is softer than the material comprising the cylindrical sleeve (9) wherein, further, said cylindrical sleeve (9) has a rear end surface with saw-tooth shaped projections (20), which rise in the axial direction, and have longer tooth faces (21), which rise in the same direction as the direction of said first internal thread for mounting of the cylindrical sleeve (9) upon the reservoir cartridge, and said reservoir cartridge intermediate wall region further comprises an annular collar (15), directed radially outward, which is rearwardly adjacent to said first external thread (16), and a second external thread (17), which is rearwardly adjacent to said annular collar (15), wherein said second external thread of said reservoir cartridge is adapted to engage with a second internal thread that is proximate a front end of a surrounding holder shaft (11), wherein the thread directions for mounting the cylindrical sleeve to the reservoir cartridge and the reservoir cartridge to the holder shaft are the same, thereby creating an increased resistance to disengagement between the sleeve and the reservoir cartridge, as rotation of the sleeve sealingly engages itself, the cylindrical body and a holder shaft with respect to the reservoir cartridge.

3. A tubular writing pen according to claim 1, wherein said soft plastic reservoir cartridge intermediate wall region further comprises an outer surface having an annular collar (15) directed radially outward, which is rearwardly adjacent to said first external thread (16), wherein the first external thread and annular collar are configured so that a rear end surface of the cylindrical sleeve (9) also sealingly will engage axially against the soft plastic cartridge proximate said annular collar (15) when said writing fluid reservoir cartridge has been pushed from the rear upon said cylindrical body, (1) and the internal thread proximate the rear end of said cylindrical sleeve (9) has been engaged upon said reservoir cartridge first external thread, (16).

4. A tubular writing pen according to claim 3, wherein said soft plastic writing fluid reservoir cartridge (6) is constructed of a synthetic material which is softer than the material comprising the cylindrical sleeve (9) wherein, further, the said cylindrical sleeve (9) has a rear end surface with saw-tooth shaped projections (20), which rise in the axial direction and have longer tooth faces (21), which rise in the same direction as the direction of said first internal thread for mounting of the cylindrical sleeve (9) upon the reservoir cartridge, wherein said reservoir cartridge intermediate wall region further comprises a second external thread (17), which is rearwardly adjacent to said annular collar (15), wherein said second external thread of the reservoir cartridge is adapted to engage with a second internal thread that is proximate a front end of a surrounding holder shaft (11), wherein the thread directions for mounting the cylindrical sleeve to the reservoir cartridge and the reservoir cartridge to the holder shaft are the same, thereby creating an increased resistance to disengagement between the holder shaft and the sleeve, as rotation of the sleeve sealingly engages itself, the cylindrical body and the holder shaft with respect to the reservoir cartridge.

5. A tubular writing pen according to claim 3, wherein said hard plastic cylindrical body annular shoulder (18) proximate the front end of said cylindrical body (1) has rearward surfaces adapted to both inwardly and axially support the soft plastic inner equalization chamber front end of the reservoir cartridge wherein said soft plastic inner equalization chamber front end axially is urged into said second sealing engagement against said hard plastic cylindrical body annular shoulder (18) by an inner surface portion of the cylindrical sleeve (9) that is proximate the front end of the cylindrical sleeve and extends radially inward to axially engage a forward surface of said hard plastic annular shoulder (18) as said cylindrical sleeve rear surface makes a first sealing engagement against the soft plastic reservoir cartridge proximate said annular collar (15).

6. A tubular writing pen according to claim 1, wherein said hard plastic cylindrical body annular shoulder (18) proximate the front end of said cylindrical body (1) has rearward surfaces adapted to both inwardly and axially support the soft plastic inner equalization chamber front end of the reservoir cartridge wherein said soft plastic inner equalization chamber front end axially is urged into said second sealing engagement against said hard plastic cylindrical body annular shoulder (18) by an inner surface portion of the cylindrical sleeve (9), that is proximate the front end of the cylindrical sleeve and extends radially inward to axially engage a forward surface of said hard plastic annular shoulder (18).

7. In a tubular writing pen writing fluid reservoir cartridge (6) of the type having a front end which is adapted to be pushed from the rear and forwardly onto the outer surface of a hard plastic cylindrical body (1) which has an inner bore to communicate ink from said reservoir cartridge to a writing capillary tube carried at the front end of said cylindrical body (1), the improvement in said reservoir cartridge which comprises a soft plastic front wall region on said reservoir cartridge (6) comprises portions adapted so as to be able to cooperate with a smooth outer surface of a hard plastic cylindrical body (1) and a smooth inner surface of a cylindrical sleeve (9), and thereby define an equalizing chamber means comprised of axially extending interconnected helical passages for a tubular writing pen that will be replaced upon replacement of said reservoir cartridge, said reservoir cartridge equalizing chamber means further a soft plastic front wall region being structurally adapted to define an outer equalizing chamber (12) and an inner equalization chamber (14) wherein an outer equalizing chamber (12) cartridge portion further comprises an outwardly open channel defined within an outer surface of said cartridge front wall region that is adapted to be covered by a smooth inner surface portion of a surrounding cylindrical sleeve (9), said outer equalization chamber cartridge portion further having a rear end that terminates proximate to a connecting bore (13) that extends transversely through said front wall region in order to interconnect with an inner equalization chamber cartridge portion, and a front end adapted to communicate surrounding air into the front end of said outer equalization chamber cartridge portion, wherein further said inner equalizing chamber cartridge portion (14) further comprises an inwardly open channel defined within an inner surface of said cartridge front wall region that is adapted to be covered by a smooth outer surface of a cylindrical body (1) said inner equalization chamber cartridge portion having a rear end which communicates with said connecting bore (13) and a front end that structurally is adapted so as to be able to communicate with a transverse bore (7) in any adjacent cylindrical body (1), wherein said cartridge further comprises a cartridge mounting means that structurally is adapted to permit a first sealing engagement between the inner equalization chamber front end portion of said cartridge and a hard plastic shoulder (18) proximate the front end of any cylindrical body (1) when any cylindrical sleeve (9) is mounted from the front and rearwardly into a surrounding relationship to the soft plastic cartridge front wall region and further comprises a soft plastic reservoir cartridge intermediate wall region, posterior to the outer equalizing chamber cartridge portion (12), which comprises an outer surface defined with an external thread (16), that structurally is adapted so as to be able to engage with an internal thread proximate a rear end of said any cylindrical sleeve (9) whereby, when said reservoir cartridge is employed according to its intended use, an inner bore of a technical pen will be communicated with surrounding air through an equalizing chamber means which will be exposed each time a cylindrical sleeve is removed forwardly from the reservoir cartridge and then the reservoir cartridge is removed rearwardly, from said any cylindrical body.

8. An improved reservoir cartridge according to claim 7, wherein said reservoir cartridge soft plastic intermediate wall region further comprises an outer surface having an annular collar (15) directed radially outward, which is rearwardly adjacent to said first external thread (16), wherein the first external thread and annular collar are comprise portions adapted so that a rear surface of any cylindrical sleeve (9) will cause sealing engagement proximate to said annular collar (15) when said writing fluid reservoir cartridge has been pushed from the rear upon a cylindrical body and said sleeve is mounted, from the front.

9. An improved reservoir cartridge according to claim 7, wherein said writing fluid reservoir cartridge (6) soft plastic comprises a synthetic material which is softer than the material comprising any cylindrical sleeve (9) intended for use with said cartridge and an annular collar (15) has a front surface adapted to be engaged deformably, by said any sleeve and wherein, said reservoir cartridge intermediate wall region further comprises a second external thread (17), which is rearwardly adjacent to said annular collar (15), and is adapted to engage with a second internal thread proximate a front end of any surrounding holder shaft (11), wherein the first and second thread directions of said cartridge, are the same and are adapted for mounting the cylindrical sleeve to the reservoir cartridge and the reservoir cartridge to any holder shaft, so as to create an increased resistance to disengagement between the sleeve and the reservoir cartridge, as rotation of any sleeve sealingly engages itself, any cylindrical body and any holder shaft, with respect to the reservoir cartridge, in an intended use.

* * * * *